US008528594B2

(12) United States Patent
Gollner

(10) Patent No.: US 8,528,594 B2
(45) Date of Patent: Sep. 10, 2013

(54) HYDRAULIC SYSTEM WITH LEAKAGE FLUID REMOVAL

(75) Inventor: Wilhelm Gollner, Neumunster (DE)

(73) Assignee: Sauer-Danfoss Inc., Ames, IA (US)

( * ) Notice: Subject to any disclaimer, the term of this patent is extended or adjusted under 35 U.S.C. 154(b) by 243 days.

(21) Appl. No.: 12/892,181

(22) Filed: Sep. 28, 2010

(65) Prior Publication Data

US 2011/0079293 A1 Apr. 7, 2011

(30) Foreign Application Priority Data

Oct. 2, 2009 (DE) ..... 10 2009 048 099

(51) Int. Cl.

| | |
|---|---|
| ***B67D 7/74*** | (2010.01) |
| ***E03B 5/00*** | (2006.01) |
| ***E03B 11/00*** | (2006.01) |
| ***E03B 7/07*** | (2006.01) |
| ***F04B 11/00*** | (2006.01) |
| ***F16L 55/04*** | (2006.01) |
| ***F16K 23/00*** | (2006.01) |
| ***F16K 37/00*** | (2006.01) |
| ***F25D 21/14*** | (2006.01) |
| ***F17D 3/00*** | (2006.01) |
| ***F16D 31/02*** | (2006.01) |

(52) U.S. Cl.

USPC ..... 137/565.34; 137/314; 137/559; 60/455

(58) Field of Classification Search

USPC ..... 137/312, 314, 565.01, 565.17, 565.34, 137/559; 60/455

See application file for complete search history.

(56) References Cited

U.S. PATENT DOCUMENTS

| | | | | | |
|---|---|---|---|---|---|
| 1,556,033 | A | * | 10/1925 | Robson | 60/325 |
| 2,158,558 | A | * | 5/1939 | Atkins et al. | 137/312 |
| 2,204,774 | A | * | 6/1940 | Rusch | 318/11 |
| 2,467,508 | A | * | 4/1949 | Trautman | 60/465 |
| 2,707,378 | A | * | 5/1955 | Ryan | 137/523 |
| 3,106,823 | A | * | 10/1963 | Thompson | 60/539 |
| 3,140,664 | A | * | 7/1964 | Thomas | 417/399 |
| 3,250,931 | A | * | 5/1966 | Hardman | 310/75 R |
| 3,365,981 | A | * | 1/1968 | Gantzer | 475/77 |
| 3,485,047 | A | * | 12/1969 | Behrens | 60/450 |

(Continued)

FOREIGN PATENT DOCUMENTS

| | | |
|---|---|---|
| DE | 4128615 | 1/1993 |
| DE | 4215869 | 9/1993 |
| DE | 4414509 | 10/1995 |

OTHER PUBLICATIONS

Jaroslav Ivantysyn, Machine Translation of Foreign Patent DE 4414509, Oct. 19, 1995.*

*Primary Examiner* — John K Fristoe, Jr.
*Assistant Examiner* — Frederick D Soski
(74) *Attorney, Agent, or Firm* — Zarley Law Firm, P.L.C.

(57) ABSTRACT

Hydraulic system with a hydraulic machine, in particular an axial piston or radial piston unit, with rotating and moving machine components which are arranged in a housing. The housing is connected to a high-pressure and a low-pressure line of a working circuit, which is supplied with pressure fluid by means of a charge pump. The leakage fluid which occurs in the housing collects in a leakage fluid reservoir which is arranged below the rotating and moving hydraulic machine components in the working position of the hydraulic machine and is connected fluidically to the housing. The leakage fluid is pumped out of the leakage fluid reservoir into the low-pressure line of the working circuit by the charge pump.

16 Claims, 6 Drawing Sheets

(56) References Cited

U.S. PATENT DOCUMENTS 5,419,130 A * 5/1995 Ruckgauer et al. ..... 60/456
5,545,013 A * 8/1996 Beck et al. ..... 417/201
5,713,241 A * 2/1998 Lamb et al. ..... 73/330
2003/0152464 A1 * 8/2003 Maier ..... 417/251
2003/0226354 A1 * 12/2003 Nippert et al. ..... 60/454
2005/0163640 A1 * 7/2005 Sieben ..... 417/572

* cited by examiner

HYDRAULIC SYSTEM WITH LEAKAGE FLUID REMOVAL

BACKGROUND OF THE INVENTION

The invention relates to a hydraulic system with a hydraulic machine, in particular an axial piston or radial piston machine, in which the moving, in particular rotating, machine components do not churn in fluid. The invention relates to all types of hydraulic machine in which leakage fluid occurs, especially for the purpose of lubrication, and is to be returned to the working circuit.

If hydraulic motors or pumps are operated in a housing filled with fluid, churning losses occur, and these increase with increasing rotational speed. Furthermore, the oil in oil-filled housings is made to foam by the moving or rotating components, causing problems, inter alia, in the onward movement of this oil into storage reservoirs. Such onward movement of the fluid with which the housing is filled is conventionally brought about by pumps or by excess pressure or a vacuum in the housing, forcing or sucking the fluid into the fluid storage reservoir of the working machine. The forced onward movement of the oil in conventional hydraulic systems is necessary since line losses due to flow resistance in the lines leading to the storage reservoir and, usually, also differences in level between the hydraulic machine and the reservoir have to be overcome. The reservoirs of conventional hydraulic working machines are normally arranged above the hydraulic motors, which are usually mounted on the axle to be driven, the said reservoirs being arranged significantly above the axle to be driven, for example.

The forced introduction of the oil into the storage reservoir leads to further turbulent mixing of the oil with the oil contained therein and the air present there. There is therefore further foaming of the fluid and hence a further increase in volume due to the inclusion of air in the oil. However, the inclusion of air in the fluid reduces the compressibility of the fluid, making it necessary to degas the fluid before the fluid removed from the housing can be returned to the working circuit. This is generally accomplished by allowing the fluid to settle in a storage reservoir of large dimensions in which the included air can escape from the oil/air mixture through the settling of the oil. For this purpose, large storage reservoirs are required since a certain time is required for the air to escape and fluid has to be removed continuously from the storage reservoir and fed to the working circuit, based on pressure or vacuum in the hydraulic machine. At the same time, there is a need to ensure that the fluid is removed without air, something that is not always the case in conventional machines.

The oil in housings of hydraulic machines, which is generally also referred to as leakage oil or leakage fluid, is formed essentially through leakage due to the lubrication and cooling of components that are moved relative to one another, especially the relative motion between pistons and cylinders, but also in the lubrication of sliding contact bearings. However, leakage can also occur in the control circuit for the hydraulic machine, which is likewise normally supplied with fluid by means of the charge pump. To enable all the moving components to be supplied with oil, the housing of the hydraulic machine is generally filled completely with oil, resulting in the churning losses already mentioned above. In conventional hydraulic machines, there is furthermore a need for pumping power to remove/circulate the oil in the housing, and this power is no longer available to the hydraulic system for doing work.

To reduce churning losses, it is advantageous, especially when operating at high rotational speeds, to remove the fluid from the machine housing so that the drive unit rotates in an "empty" housing, i.e. the rotating and moving machine components do not churn or run in oil. Hydraulic machines of this kind are also referred to as dry-case machines.

Various methods have been proposed for removing the fluid from the housing, all of them based on sucking or forcing the leakage fluid out by means of excess pressure. Here, use is generally made of pumps which either suck the housing of the hydraulic machine dry or produce an excess pressure in the housing, thereby sucking or forcing the leakage oil out of the housing of the hydraulic machine into a storage reservoir. In order to ensure that the housing is sucked or pumped dry, the additional pumps used for this purpose are overdimensioned. As a result, too much oil is generally sucked out of the housing of the hydraulic machine, as a result of which an unnecessary amount of air is taken along and fed to the reservoir. The effect of this air, especially due to the intended complete removal of continuously inflowing leakage oil, is increased foaming of the oil in the reservoir and, in many cases, spilling over of foam in the reservoir.

DE 41 28 615 C1, for example, has proposed arranging a pumping device between the case drain port and the reservoir for the purpose of sucking leakage oil out of a housing in order to ensure that the drive unit components do not run in leakage oil. Here, the leakage oil is withdrawn completely and continuously, together with air, out of the bottom of the housing of the hydraulic machine and forced to a reservoir by means of an additional leakage oil pump.

DE 42 15 869 C1 discloses the arrangement, in the interior of the housing, of a pumping device which is in drive connection with the drive unit and is provided for the purpose of pumping leakage oil out of the housing and into a reservoir.

DE 44 14 509 C1 has furthermore proposed a method for removing fluid from a housing of a hydrostatic machine, in which the foamed leakage fluid is removed from the housing by supplying excess pressure or applying a vacuum to the housing and is forced to a reservoir. The power required for the excess pressure and vacuum pump must be provided by the main drive engine, e.g. an internal combustion engine, and is thus no longer available for the hydraulic drive.

To enable the leakage fluid or working fluid to be sucked out of the housing by means of any pump device, the said device must be designed for the full leakage fluid flow. The required power for the suction pump must therefore be correspondingly large and, as a result, the desired power saving through the avoidance of churning losses is significantly lower than the churning losses saved. Furthermore, the additional pump requires a considerable installation space, either within or outside the drive unit.

The leakage oil removed from the hydraulic machine is then passed into a reservoir, in which the hydraulic fluid can settle and release included gas particles. Since this takes a certain time, the swirled volume of fluid is not available to the working circuit, the result being that the quantity of hydraulic fluid is greater than is actually needed for the working circuit to be supplied by the charge pump.

The more time the fluid forced into the reservoir has to allow the gas included in it to escape, the better is the compression behaviour of the fluid and hence the efficiency of the hydraulic drive. Thus the oil reservoirs in conventional hydraulic systems are of large dimensions to ensure that the air has sufficient time to escape from the oil and hence that as little gas/air as possible is pumped into the working circuit by the charge pump that sucks the working fluid out of the storage reservoir.

In all the systems previously presented, all of the working fluid that occurs in the housing as a result of leakage is forcibly removed from the housing of the hydraulic machine and fed to a reservoir. In these systems, the leakage fluid is already carrying gas particles as it emerges from the housing, and these are foamed even more, together with the oil, by the rotation of the rotating machine components or, at the latest, when they are introduced into the reservoir. In the reservoir, there is the further effect that the reservoirs become clogged with foam over time. Foam is formed that does not break down again, even after a long settling time. Over time, therefore, the reservoir becomes clogged with foam. This additional volume required by such foam must also be taken into account when designing the reservoir volume.

It is the object of the invention to provide a hydraulic system in which at least the rotating machine components do not churn in oil, and an additional pump for removing leakage oil from the hydraulic machine and foaming of the leakage oil are avoided. At the same time, mixing of gas or air with the leakage fluid shall be avoided.

The object is achieved with a hydraulic system according to Claim 1. The subclaims that depend on Claim 1 are directed to advantageous embodiments of the hydraulic system.

The object is likewise achieved with a hydraulic drive according to Claim 9. The subclaims that depend on Claim 9 are directed to preferred embodiments of the hydraulic drive.

SUMMARY OF THE INVENTION

The hydraulic system according to the invention has a hydraulic machine, in particular an axial piston or radial piston machine, which is connected to a high-pressure and a low-pressure line of a working circuit. The hydraulic machine can be supplied with fluid by means of a charge pump arranged in the hydraulic system. The hydraulic machine furthermore has a leakage oil reservoir which is arranged below the moving or rotating hydraulic machine components in the working position of the hydraulic machine and in which the leakage fluid which occurs is collected. In this arrangement, the leakage fluid reservoir can be connected via a leakage line to the charge pump, which pumps the leakage fluid out of the leakage fluid reservoir into the low-pressure line of the working circuit. The charge pump pumps the leakage oil into the low-pressure line of the working circuit when there is a lack of hydraulic fluid in the working circuit owing to leakage in the hydraulic machine. The leakage fluid reservoir, which is arranged directly on the hydraulic machine, below the rotating drive components, is accordingly not sucked dry by the charge pump, as is the case with the prior art systems with leakage oil pumps.

In contrast to the prior art, the leakage oil that occurs is not removed forcibly from the housing of the hydraulic machine; instead, the leakage fluid that occurs collects in a leakage oil reservoir below the rotating hydraulic machine components by gravity.

In a further contrast with the prior art, the leakage oil reservoir does not need to be used to settle forcibly removed hydraulic fluid since virtually no oil/gas mixture forms in the leakage oil reservoir, owing to the gentle introduction of the leakage fluid into the leakage fluid volume by gravity. Moreover, the rotating and moving machine components do not run in oil and hence foaming of the oil is avoided. As a result, the leakage oil that has collected in the leakage oil volume can be passed on to the working circuit or to the input pump of the working circuit, i.e. to the charge pump, directly, without entering another storage reservoir. The volume of the leakage fluid reservoir can thus be kept correspondingly small since settling of the leakage oil fluid is not necessary.

This gives a hydraulic system which forms a compact hydraulic unit owing to the elimination of an additional pump for forcibly removing leakage oil and the resulting small volume for collecting leakage oil. Furthermore, there are no churning losses. Nevertheless, lubrication, by intentional leakage or by the oil emerging from the purging, feed or control circuit for example, is assured. There is also no power loss due to the driving of an additional leakage pump, because there is no such pump.

The hydraulic system proposed according to the invention furthermore manages with a smaller quantity of oil since it is not necessary for an agitated or forced hydraulic oil volume to settle. For this reason, too, the hydraulic system can thus be designed with a smaller overall volume. Storage for the purpose of settling leakage oil is not required. The leakage fluid which occurs in the leakage space can be fed directly to the working circuit without the reservoir dwell time required for degassing. In the case of hydrostatic drives, for example, this is generally accomplished by feeding the oil to the low-pressure line.

Devices for producing and maintaining a particular housing pressure within the hydraulic machine are not required in the arrangement according to the invention either. The hydraulic system according to the invention operates with ambient pressure in the housing.

For cooling and cleaning the leakage oil which occurs in the hydraulic system according to the invention, both heat exchangers and filters can be provided in the leakage line leading from the leakage space to the charge pump. These devices for cooling and cleaning do not impede the inventive concept—that of feeding leakage oil directly to the charge pump—since there is no intermediate storage for settling the leakage oil.

It is thus possible to operate the hydraulic system with a precisely defined and significantly smaller quantity of fluid than is required by the prior art. In conventional hydraulic drives, it is necessary to assume a quantity of foamed oil at full load, and this is not available to the working circuit until it has settled. However, this has to be taken into account accordingly in the design of the storage reservoir. In the prior art, the storage reservoir for holding leakage fluid must therefore be of relatively large size. In the system according to the invention, the installation space required for this purpose is available for other components.

The required quantity of fluid for a hydraulic system according to the invention can therefore be calculated precisely since uncontrolled foaming is avoided. Thus, for example, a predetermined quantity of fluid is introduced into the hydraulic system when it is first put into operation, for example, ensuring that the fluid level remains below the rotating and moving component of the hydraulic machine. The fluid level in the leakage fluid reservoir can be checked easily, e.g. by means of a sight glass installed in a housing wall of the leakage oil reservoir, for example.

Also provided in the housing of the hydraulic machine is a ventilation opening to enable pressure compensation or volume compensation to take place as the leakage fluid is sucked out of the leakage fluid volume by means of the charge pump or input pump of the hydraulic machine. As is customary, this ventilation opening can be closed by a valve which opens the ventilation opening at a certain pressure. This can take place, for example, when a certain threshold pressure is undershot owing to the suction of the charge pump for the working circuit. However, pressure compensation via the ventilation opening of the hydraulic system is also possible when a certain pressure in the housing is exceeded owing to an increase in temperature and the associated expansion in the volume of the leakage oil and of the air present in the housing of the hydraulic machine.

The leakage fluid reservoir is preferably attached directly to the hydraulic machine in which the leakage fluid occurs. In this arrangement, the leakage oil reservoir can form a component volume of the housing of the hydraulic machine arranged below the rotating machine components. Under gravity, the leakage oil which occurs collects in the volume provided for the leakage oil, e.g. in a type of oil pan, and can be sucked off by the charge pump of the working circuit via a leakage line connected at the bottom of the hydraulic machine. Pressure compensation is accomplished via the ventilation opening in the housing.

Arrangement of a separate leakage fluid reservoir below the hydraulic machine in which the leakage fluid occurs is provided as a further embodiment, the leakage fluid resevoir being connected fluidically to the bottom of the hydraulic machine in such a way that leakage oil which occurs flows into the leakage oil resevoir under gravity. In this arrangement, the leakage fluid reservoir can be attached to the hydraulic machine in such a way that there is no need for a line to connect the resevoir and the machine. However, such a connecting line is likewise included in the inventive concept, given the installation space that is available. When such a line is employed, too, the invention requires that the leakage oil reservoir be arranged at a lower level within the hydraulic system than the machine components rotating in the hydraulic machine in order to ensure that the leakage oil can flow into the leakage fluid reservoir under gravity and that moving or rotating machine components do not churn in oil.

In a hydraulic system with an external leakage fluid resevoir, a hitherto conventional hydraulic machine can be used, the leakage oil from which can be fed to the leakage fluid resevoir according to the invention through a leakage line attached to the bottom of the housing. This enables the oil to flow out of the hydraulic machine into the leakage oil collecting resevoir by gravity and to be sucked out of the said resevoir by the charge pump. It is a prerequisite here that the leakage fluid resevoir within the hydraulic system should be arranged at a vertical level below the rotating or moving parts of the hydraulic machine, that oil should be fed to the resevoir by gravity and that there should be an oil line connecting the resevoir to the charge pump.

The leakage fluid can be sucked out of the leakage oil reservoir by the charge pump through a leakage line attached at the bottom of the leakage oil reservoir and fed to the working circuit. In this embodiment—with an external reservoir—an air conduit connecting the top of the leakage fluid resevoir to the top of the inner hydraulic machine volume can be provided for the pressure compensation made necessary by the suction or by temperature fluctuations. It is thereby possible to avoid air exchange with the surroundings when the conditions in which the hydraulic machine is being used are adverse, for example. There is then no need for additional devices for cleaning incoming air. The leakage fluid recovery system is thus self-contained. If leakage fluid is sucked out of the leakage fluid resevoir, the volume of air required for volume compensation at ambient pressure can be fed back into the leakage fluid resevoir via the housing of the hydraulic machine. A ventilation opening arranged in the housing of the hydraulic machine can then ensure the required pressure compensation in the housing of the hydraulic machine.

Since it is not possible completely to avoid entrainment of air into the leakage oil reservoir by the inflow of the leakage oil, even with the system according to the invention, the air escaping from the oil in the leakage oil reservoir can be reintroduced into the housing of the hydraulic machine via the air conduit.

The hydrostatic system according to the invention, which has a hydraulic machine which is connected to a high-pressure and a low-pressure line of a working circuit, can be employed, for example, in a hydrostatic drive in which an additional hydraulic machine is incorporated into the working circuit. If the hydraulic machine of the hydrostatic system is a hydraulic motor, for example, and the additional hydraulic machine is a hydraulic pump, this makes it possible to achieve a hydraulic drive in which the hydraulic pump supplies the hydraulic motor with pressure fluid under high pressure. The hydraulic motor, for its part, passes the pressure fluid back to the hydraulic pump at low pressure. This can take place either in a closed or an open circuit.

Because of the relatively high rotational speeds occurring in the hydraulic motor, a leakage fluid reservoir which can be filled with leakage fluid by gravity will preferably be provided there in accordance with the invention. In addition, a leakage oil reservoir according to the invention with a fluidic connection to the charge pump of the hydrostatic circuit can also be provided at the hydraulic pump in order likewise to avoid churning losses at the pump.

If a hydraulic drive has a leakage fluid reservoir both at the hydraulic pump and at the hydraulic motor, these can each be connected to the charge pump of the hydraulic system by a leakage line to enable the charge pump to suck the leakage oil out of the two reservoirs and return it to the working circuit. However, it is also possible for the individual reservoirs to be connected to one another by further leakage connection lines, with the charge pump removing the leakage oil from the lowermost leakage oil reservoir and pumping it into the low-pressure line. The leakage oil from the reservoirs which are at a higher level then flows into the lowermost leakage oil reservoir.

It is self-evident that a hydraulic drive or a hydraulic system can also have a plurality of hydraulic machines on which the inventive concept is implemented. The individual leakage fluid resevoirs can then be connected to one another fluidically or be connected directly to the charge pump in a manner that is routine for a person skilled in the art. The inventive concept also covers the situation where individual leakage oil reservoirs are combined in groups.

Further details and preferred illustrative embodiments will be explained specifically in greater detail below by way of example using the attached drawings, in which:

DETAILED DESCRIPTION OF THE PREFERRED EMBODIMENTS

For the sake of simplicity, identical objects in the individual figures are provided with identical reference signs.

Figure 1:
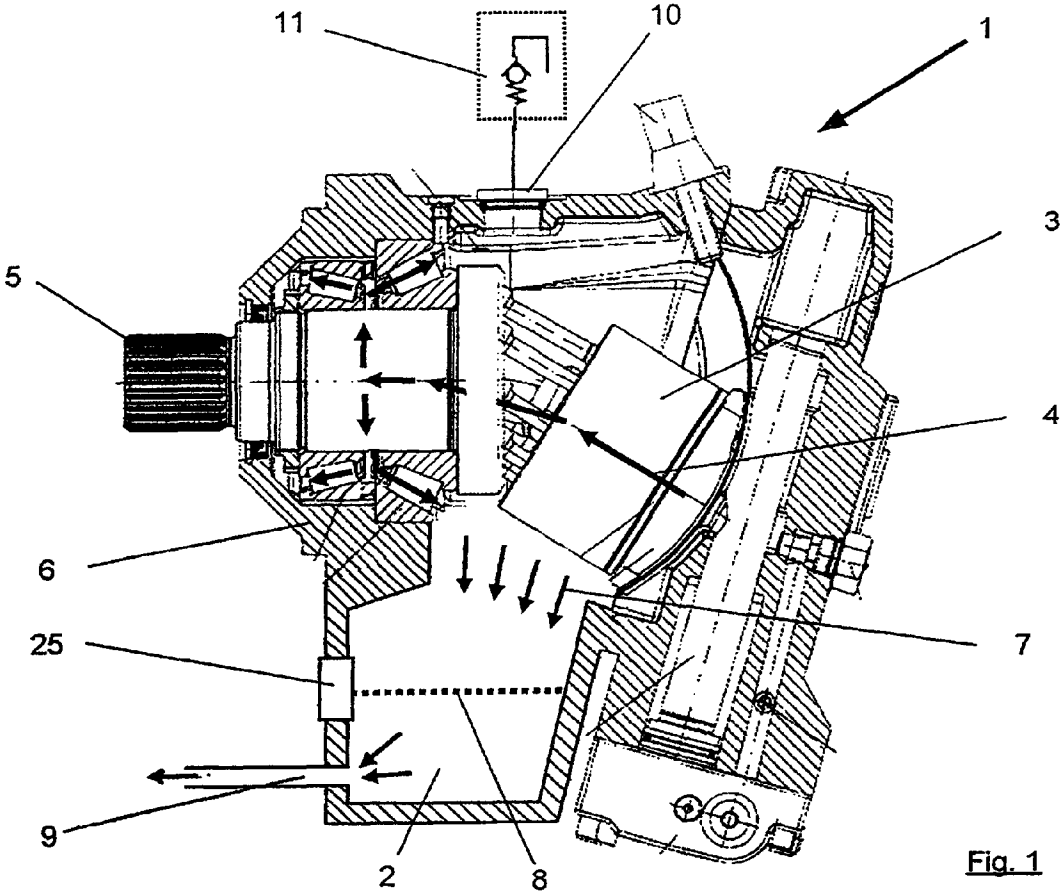
FIG. 1 shows a sectional representation of a hydraulic motor with a leakage oil reservoir arranged in the housing of the hydraulic motor.

The hydraulic motor 1 illustrated in FIG. 1 is, for example, a hydraulic motor of the bent-axis type, the cylinder block 3 of which is angled to drive a shaft. The cylinder block 3 rotates owing to the supply of pressure fluid under high pressure, the pistons, which are aligned along the bent axis 4 in the cylinder block 3 moving backwards and forwards linearly and thereby bringing about the rotation of the shaft 5. The cylinder block 3, the pistons and their joint with the shaft 5, and the shaft 5 itself, are accommodated by a motor housing 6. The operation of a bent-axis hydraulic machine is sufficiently well known to those skilled in the art and is not essential to the explanation of the invention, and it is therefore possible, for the sake of simplifying the explanation, to dispense with an explanation of how the hydraulic machine is integrated into a working circuit.

If the motor housing 6 were filled with oil, as is customary in the case of many conventional motors, the cylinder block 3 with the pistons moved in a linear manner therein would run in oil and would generate a corresponding speed-dependent power loss and would cause the oil in the motor housing 6 to foam.

As illustrated in FIG. 1, there is oil only at the bottom of the motor housing 6, in a leakage fluid reservoir 2 below the rotating cylinder block 3. The leakage fluid reservoir 2 is formed by the motor housing 6 in this region. The embodiment shown in FIG. 1 also encompasses an integrated design in the form of an oil pan flanged to the motor housing. The arrows indicate the leakage oil 7 and the direction of flow thereof and furthermore show that the leakage oil flows out of the top of the motor housing 6 into the leakage fluid reservoir 2 by gravity and thus fills the reservoir 2. In FIG. 1, the leakage fluid reservoir 2 is partially filled, this being indicated by the filling level line 8. The rotating and moving machine components, especially the shaft 5 with the piston-rod connection disc, the cylinder block 3 and the axial pistons thus move in a virtually oil-free space, in which there is only leakage oil for the purpose of lubricating the components moving and rotating relative to one another. This leakage oil is guided to the sliding surfaces of the moving components. Under gravity, excess oil runs through the motor housing into the leakage oil space 2 arranged at the bottom.

A leakage oil line 9 leads out of the bottom of the leakage oil resevoir 2 to the charge pump 15 (cf FIG. 3) of the hydraulic system. When required, the charge pump 15 pumps the leakage fluid 7 removed from the working circuit through intentional or unintentional leakage into the low-pressure line of the hydraulic system and thus returns the leakage fluid to the working circuit. The charge pump 15 thus sucks fluid out of the leakage fluid resevoir 2, as required to cover the requirements of the connected loads. Excess oil pumped out of the leakage fluid reservoir 2 by the charge pump can be returned to the leakage oil reservoir 2 via the charge relief valve, for example. The leakage oil reservoir 2 will therefore always contain a minimum quantity of oil.

A ventilation opening 10, through which ambient air, for example, can enter the housing 6 when the charge pump sucks oil out of the leakage resevoir 2, is provided at the top of the housing 6. The ventilation opening 10 can be closed by a ventilation valve 11, for example, the said valve opening the ventilation opening 10 if a specified threshold pressure is undershot and/or exceeded. Thus, for example, increases in volume due to an increase in temperature in the housing can be compensated for in a controlled manner by means of the ventilation valve. However, a ventilation opening 10 of this kind can also be provided directly on the reservoir 2.

Figure 2:
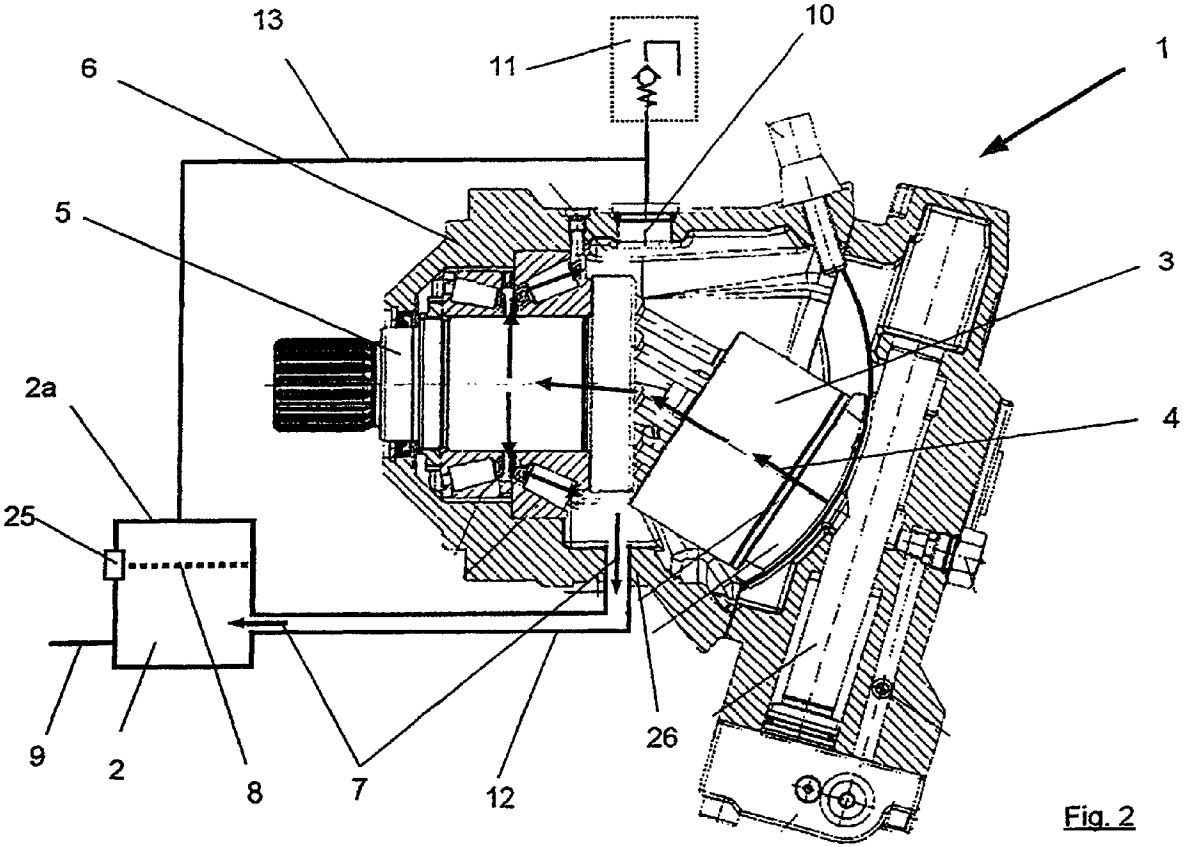
FIG. 2 shows a sectional representation of a hydraulic motor with a leakage oil reservoir arranged below the housing of the hydraulic motor.

Like FIG. 1, FIG. 2 shows a hydraulic motor 1 of the bent-axis type. In contrast to the hydraulic system shown in FIG. 1, the leakage oil reservoir 2 is not part of the motor housing 6 but is arranged as a separate resevoir 2 below the rotating and moving components. The leakage fluid which occurs at the sliding surfaces flows into the leakage oil reservoir 2 by gravity and the moving machine components of the hydraulic motor do not churn in oil.

Figure 3:
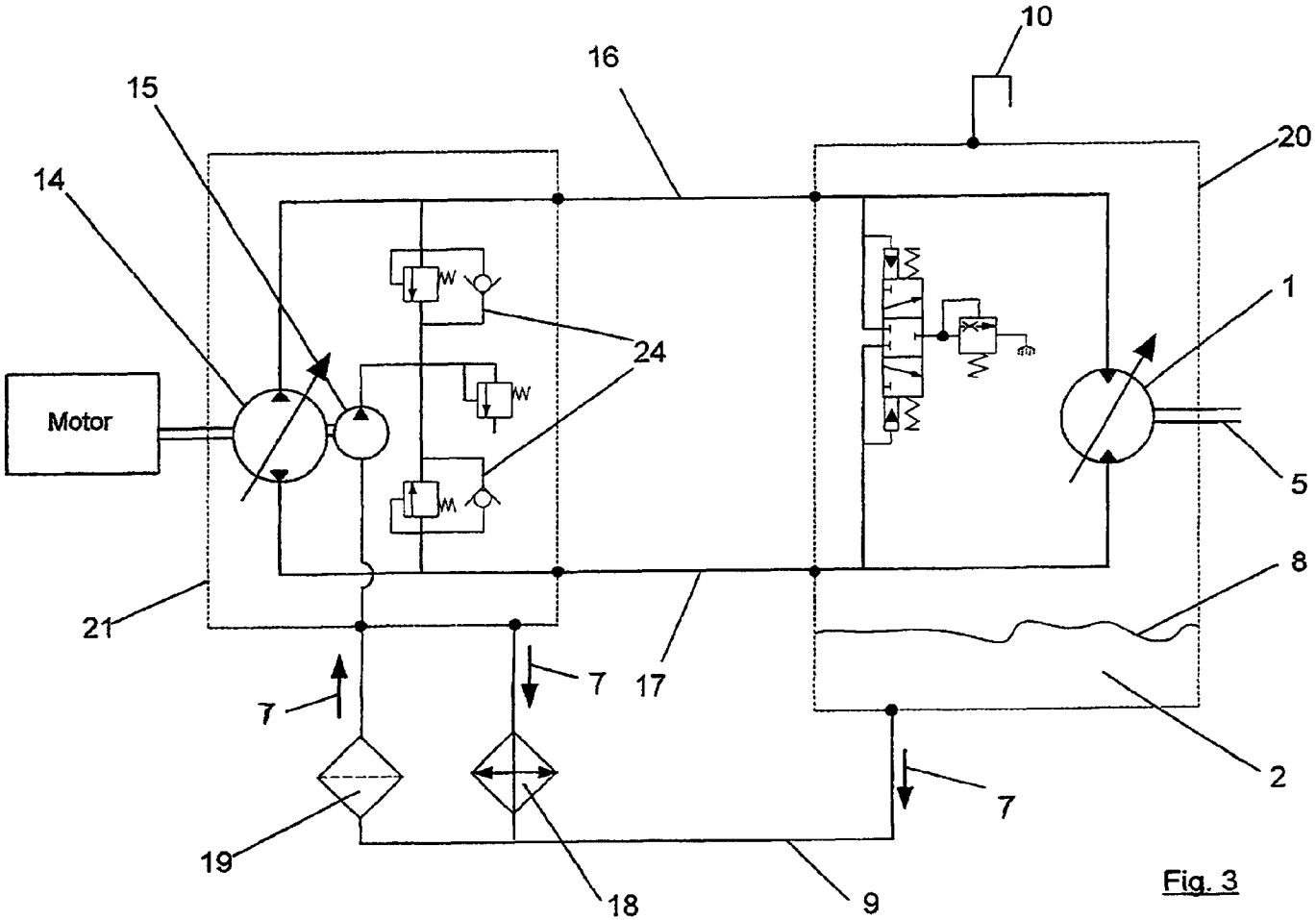
FIG. 3 shows a circuit diagram of a hydrostatic drive in which only the hydraulic motor is fitted with a leakage oil reservoir according to the invention, the leakage oil reservoir being integrated into the motor housing.

Leading out of the leakage oil reservoir 2 to the charge pump 15 is a line 9 (cf FIG. 3). Via this line, oil can be fed out of the leakage oil reservoir 2 to a load by the charge pump 15. To admit and discharge air to/from the leakage oil reservoir 2, an air conduit 13 is provided at the top of the reservoir 2, the said line connecting the volumes of the leakage oil reservoir 2 and the motor housing 6 to enable the pressures in both volumes to be compensated. If oil 7 runs from the hydraulic motor 1 into the leakage oil reservoir 2, the air displaced therein is fed to the interior of the housing 6 of the motor 1 via the air conduit 13 and thus compensates for the reduced pressure in the motor housing 6 caused by the outflow of the oil. To compensate for changes in volume and pressure fluctuations resulting therefrom, caused by changes in temperature, for example, the ventilation opening 10 of the housing 6 can be provided with a known ventilation valve 11, like the housing 6 in FIG. 1.

FIG. 3 shows a circuit diagram for a hydrostatic drive, in which a hydraulic motor 1 is supplied with fluid for driving the shaft 5 by a hydraulic pump 14 via a high-pressure line 16. Via the low-pressure line 17, the working fluid is returned to the hydraulic pump 14. The hydraulic machines illustrated in FIG. 3 have a variable displacement rate and are also reversible in terms of their direction of flow. It is self-evident to a person skilled in the art and of no significance to the practicability of the inventive concept that it would also be possible to use fixed-displacement machines or hydraulic machines that are not reversible in terms of their direction of flow but are variable, instead of the variable and reversible hydraulic machines.

The hydraulic drive in FIG. 3 has a hydraulic pump 14, the pump housing (represented by pump zone boundary 21) of which is filled with oil, and a hydraulic motor 1, the moving and rotating components of which do not run in an oil bath (oil sump) and the motor housing (represented by motor zone boundary 20) of which has at the bottom a leakage oil space 2 in which any leakage oil which occurs can collect. Reference sign 8 indicates schematically the leakage fluid level in the motor housing 6. Via the leakage line 9, the charge pump 15 can suck the leakage oil out of the leakage oil reservoir 2 and supply it to the low-pressure line 17 and hence feed it back into the working circuit. To cool and clean the leakage oil, a heat exchanger 18 and/or a filter 19 can optionally be inserted in the leakage line 9. The air admission and discharge opening required for volume compensation, the open and closed position of which is preferably controlled by means of a valve 11, is denoted by reference sign 10 in FIG. 3.

Figure 4:
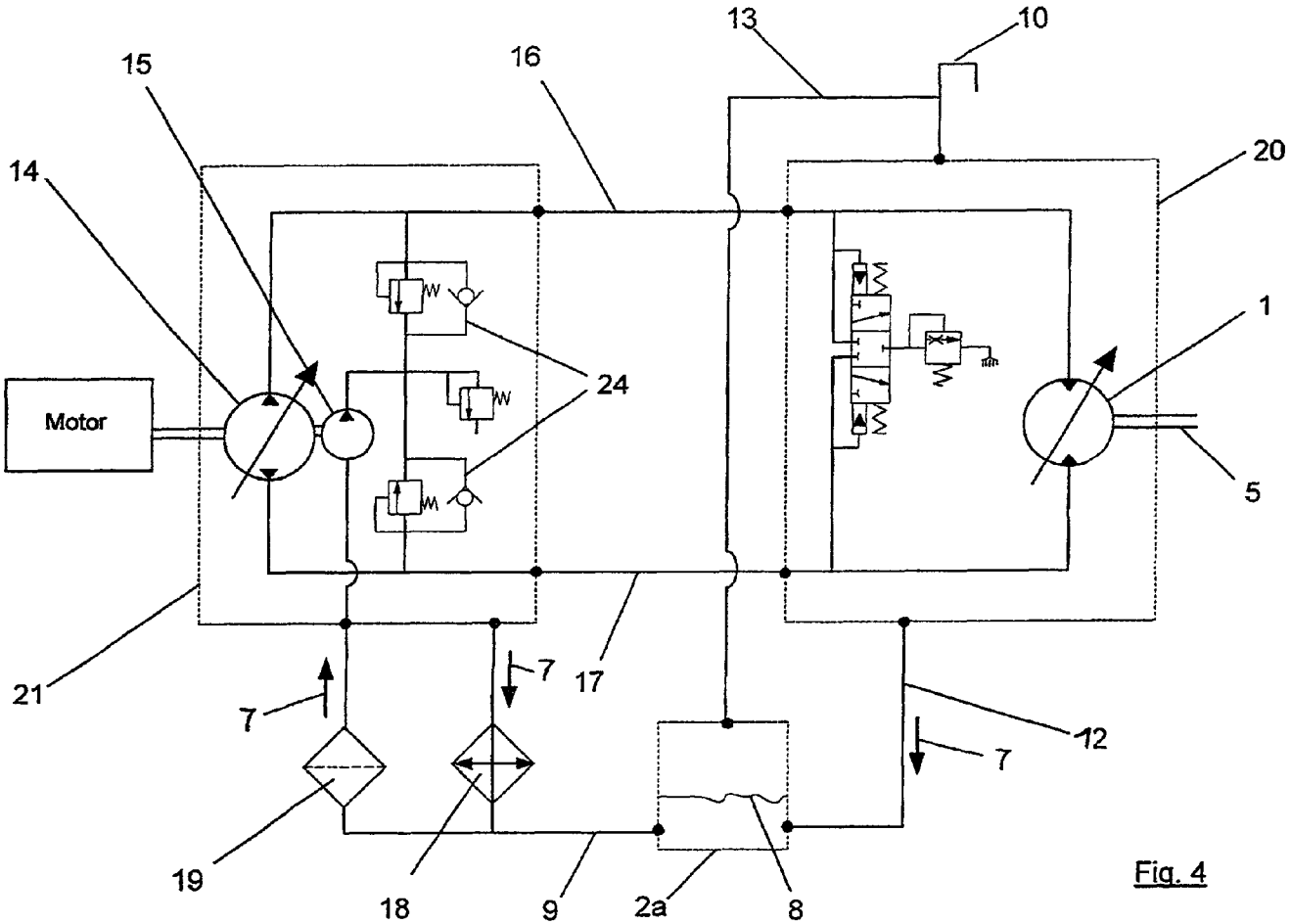
FIG. 4 shows a circuit diagram of a hydrostatic drive in which only the hydraulic motor is fitted with a leakage oil reservoir according to the invention, the leakage oil reservoir being arranged below the motor housing.

As a departure from FIG. 3, FIG. 4 shows a hydraulic system according to the invention in which the leakage fluid reservoir 2 is arranged outside the housing of the hydraulic motor 1. The leakage fluid level is again indicated by reference sign 8 and can be checked by means of a sight glass 25, for example, installed in a housing wall of the leakage oil reservoir. The air conduit 13 required for air compensation leads from the top of the leakage fluid resevoir 2 to the top of the motor housing (represented by motor zone boundary 20). Via the line 9 leading away from the leakage fluid reservoir 2, the charge pump 15 can return the leakage oil to the working circuit.

As a departure from the depiction of an external resevoir mounted on the motor housing to hold leakage fluid, as illustrated in FIG. 2, the external resevoir in the arrangement in FIG. 4 is connected to the motor housing (represented by motor zone boundary 20) by an additional leakage line 12. It is also clear from FIG. 4 that the leakage fluid reservoir 2 must be arranged at least below the rotating components in the motor 1 within the hydraulic system to ensure that the leakage fluid 7 can flow into the leakage fluid reservoir 2 by gravity.

It is also possible to see from FIG. 4 that the hydraulic machines employed can be variable-displacement hydraulic machines which each have just one direction of delivery. However, reversible machines will preferably be used in a hydrostatic travel drive to enable overrunning operation of the vehicle, in which the driving pump becomes a motor and the motor driving the vehicle becomes a pump without a reversal in the direction of flow. In a hydrostatic travel drive, preference is furthermore given to the use of pumps and motors which likewise permit a reversal in the direction of rotation of the pump and the motor, changing the high-pressure line into the low-pressure line and vice versa. This is taken into account in FIGS. 3 to 5 by the dual embodiment of the valve 24 for feeding the leakage oil 7 back into the working circuit.

Figure 5:
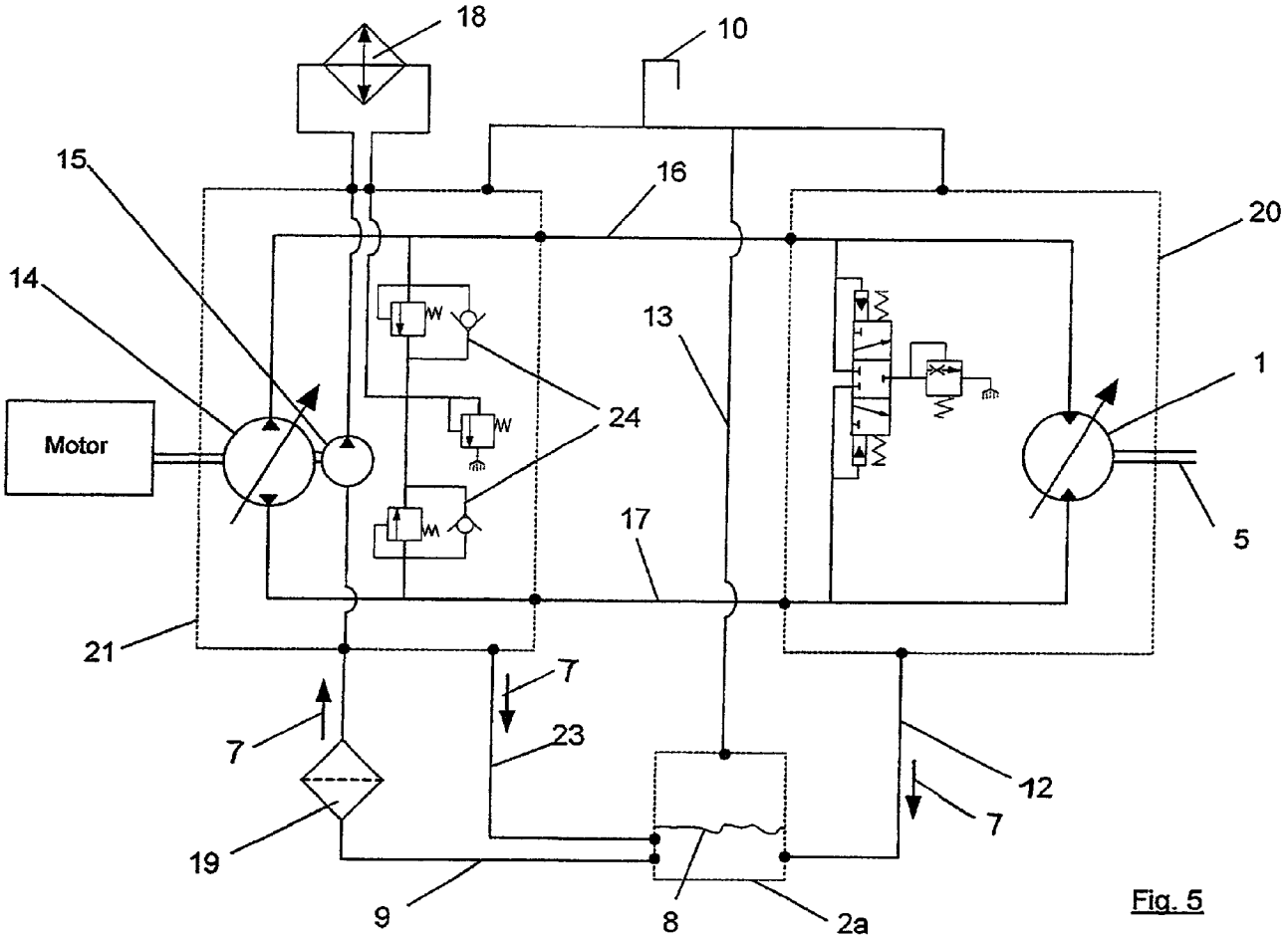
FIG. 5 shows a circuit diagram of a hydrostatic drive in which the hydraulic motor and the hydraulic pump are fitted with a leakage oil reservoir according to the invention, the leakage oil reservoir being arranged below the motor housing and below the pump housing.

Finally, FIG. 5 shows by way of example a hydrostatic drive in which both the hydraulic pump 14 and the hydraulic motor 1 direct the leakage oil 7 into a common leakage reservoir 2 and thus neither hydraulic machine has an oil-filled housing in which the rotating and moving machine components could churn in fluid. Both the pump housing (represented by pump zone boundary 21) and the motor housing (represented by motor zone boundary 20) are therefore very largely oil-free. In them, only the emerging leakage oil from openings arranged below the moving parts of the respective machine runs into the leakage lines 22 and 23 provided there, which carry the leakage oil 7 into the leakage oil reservoir 2. As in the other illustrative embodiments, the leakage oil reservoir 2 must be arranged below the openings at which the leakage oil lines 22 and 23 are mounted to ensure that the leakage oil can flow into the leakage oil reservoir 2 by gravity. From the leakage oil reservoir 2, the leakage oil line 9 carries the leakage oil onwards to the charge pump 15, which returns the leakage oil to the working circuit if required.

For pressure compensation in the two housings with the leakage oil resevoir 2, there is once again an air conduit 13 which connects the top of each of the two housings to the top of the leakage oil reservoir. In this arrangement, the air conduit 13 can communicate with the environment via an air admission and discharge device 10, and it is also possible for an air admission and discharge device 10 of this kind to be provided separately on each housing. The air admission and discharge device 10 can have an air admission or discharge valve 11 of the type illustrated in FIGS. 1 and 2.

Figure 6:
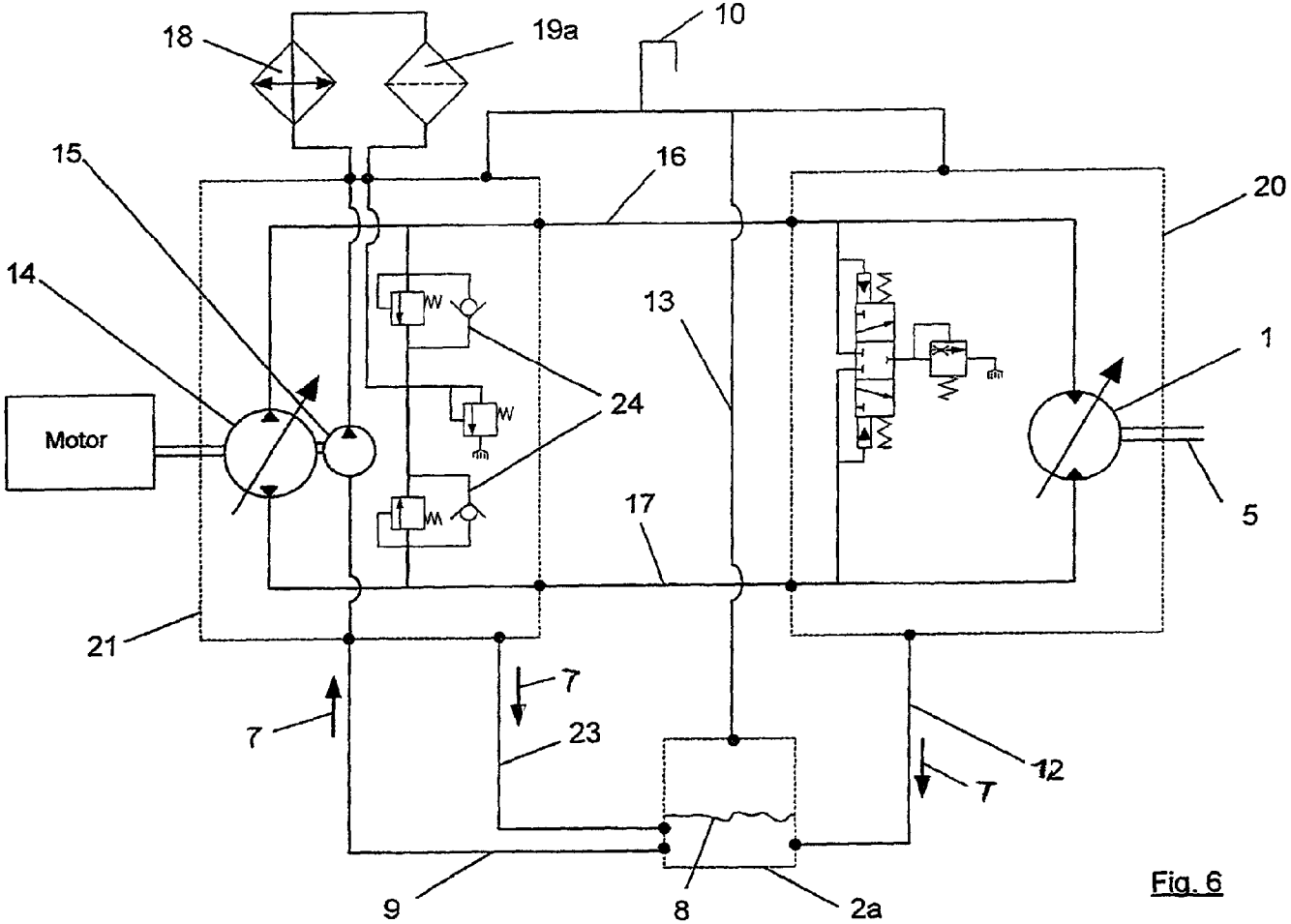
FIG. 6 shows a circuit diagram of a hydrostatic drive in accordance with FIG. 5 with an alternative arrangement for cooling and cleaning the fluid.

FIG. 5 also shows an alternative arrangement of the heat exchanger 18 and of the filter 19 for cooling and cleaning the leakage oil fluid respectively. Here, the filter 19 for cleaning the leakage oil 7 is arranged in the leakage line 9 leading to the charge pump 15, and the heat exchanger 18 is arranged at the output of the charge pump 15. Cleaning of the leakage oil together with cleaning of the working fluid can also take place at some other point in the circuit. An illustrative arrangement is shown in FIG. 6, in which a pressure filter 19 and a pressure cooler 18 are arranged downstream of the charge pump 16. This arrangement is preferred specifically for use in cold regions in order to minimize restrictions during suction by the charge pump 15.

Other ways of embodying the system according to the invention in a hydraulic drive or some other hydraulic device are encompassed by the inventive concept, provided that at least one housing of a hydraulic machine does not have any machine components that churn in oil, and that any leakage oil that occurs is collected by gravity in a leakage oil reservoir arranged below the rotating component and from there is returned to the working circuit via a leakage line by means of the charge pump of the hydraulic system.

The invention claimed is:

1. A hydraulic system with a first hydraulic machine (1), comprising an axial piston or a radial piston unit, with a rotating component and a moving machine component which are arranged in a housing (6), to which are connected a high-pressure (16) and a low-pressure line (17) of a working circuit, which is supplied with fluid by means of a charge pump (15), wherein a leakage fluid (7) occurs in the housing (6), characterized in that, by gravity, the leakage fluid (7) collects exclusively in a leakage fluid reservoir (2) which is arranged below the rotating component and moving machine component in a working position of the first hydraulic machine (1) and is connected fluidically to the housing, the leakage fluid (7) being pumped out of the leakage fluid reservoir (2) into the low-pressure line (17) of the working circuit exclusively by the charge pump (15) and an air conduit at the top of the reservoir connecting the reservoir and the motor housing, so that reduced pressure in the housing is compensated by increased pressure in the reservoir.

2. The hydraulic system according to claim 1, in which the leakage fluid reservoir (2) is connected to the charge pump (15) via a first leakage fluid line (9).

3. The hydraulic system according to claim 1, in which a fluid level in the leakage fluid reservoir (2) can be checked by means of a sight glass (25), which is arranged in a side wall of the leakage fluid reservoir (2).

4. The hydraulic system according claim 1, in which the housing (6) of the first hydraulic machine (1) has a ventilation opening (10).

5. The hydraulic system according to claim 1, in which the leakage fluid reservoir (2) is of integral construction with the housing (6) of the first hydraulic machine (1).

6. The hydraulic system according to claim 1, in which the leakage fluid reservoir (2) is arranged in the region of the housing (6) of the first hydraulic machine (1) which is at the bottom in the working position of the first hydraulic machine (1) and is connected fluidically to the housing via a leakage oil drain opening (26) at the bottom of the housing.

7. The hydraulic system according to claim 1, in which the leakage fluid reservoir (2) is arranged below the first hydraulic machine (1) in the working position of the first hydraulic machine (1), and a second leakage fluid line (12) connects the bottom of the housing (6) to the leakage fluid reservoir (2).

8. The hydraulic system according to claim 1 having a second hydraulic machine (14), comprising an axial piston or a radial piston unit, with a housing in which a rotating component and a moving machine component are arranged, and in which a leakage fluid (7) occurs below the rotating component and moving machine component in a working position, the said leakage fluid collecting only in the leakage fluid reservoir (2) assigned to the first hydraulic machine (1) and the second hydraulic machine (14).

9. The hydraulic system according to claim 1 further comprising a heat exchanger positioned between the leakage fluid reservoir (2) and the charge pump (15).

10. The hydraulic system according to claim 1 further comprising a heat exchanger positioned between the charge pump (15) and the low-pressure line (17).

11. The hydraulic system according to claim 1 further comprising a filter positioned between the leakage fluid reservoir (2) and the charge pump (15).

12. The hydraulic system according to claim 1 further comprising a filter positioned between the charge pump (15) and the low-pressure line (17).

13. The hydraulic system according to claim 1 wherein the leakage fluid (7) is fed into the working circuit via a valve positioned after the charge pump (15).

14. The hydraulic system according to claim 5 wherein a ventilation opening (10) has a valve which opens or closes the ventilation opening (10) at a predetermined pressure.

15. The hydraulic system according to claim 5 wherein a ventilation opening (10) has a valve which opens or closes the ventilation opening (10) in response to a threshold pressure of the charge pump (15).

16. The hydraulic system according to claim 5 wherein a ventilation opening (10) has a valve which opens or closes the ventilation opening (10) in response to a change in temperature.

* * * * *